US007297043B2

(12) United States Patent
Lam

(10) Patent No.: US 7,297,043 B2
(45) Date of Patent: Nov. 20, 2007

(54) TOY ROCKET LAUNCHER FOR MULTIPLE SOFT TOY ROCKETS

(75) Inventor: Ying Lung Lam, Hong Kong (CN)

(73) Assignee: D & S Toys Company Ltd., Fo Tan, Hong Kong (CN)

( * ) Notice: Subject to any disclaimer, the term of this patent is extended or adjusted under 35 U.S.C. 154(b) by 42 days.

(21) Appl. No.: 11/228,156

(22) Filed: Sep. 16, 2005

(65) Prior Publication Data

US 2007/0077852 A1 Apr. 5, 2007

(51) Int. Cl.
*A63H 27/26* (2006.01)
*A63H 27/00* (2006.01)

(52) U.S. Cl. ..... 446/211; 446/212; 124/65; 124/67

(58) Field of Classification Search ..... 472/92, 472/94; 446/176, 180, 211, 212, 429; 124/65, 124/67

See application file for complete search history.

(56) References Cited

U.S. PATENT DOCUMENTS 2,609,811 A * 9/1952 Lawrence ..... 124/48
3,009,453 A * 11/1961 Ayala ..... 124/27
3,726,266 A * 4/1973 Palmer ..... 124/59
5,186,156 A * 2/1993 Clayton ..... 124/59
5,267,549 A * 12/1993 Webber ..... 124/65
5,535,729 A * 7/1996 Griffin et al. ..... 124/66
6,568,985 B1 * 5/2003 Binkley ..... 446/176

* cited by examiner

*Primary Examiner*—Kien T Nguyen
(74) *Attorney, Agent, or Firm*—Jensen & Puntigam, P.S.

(57) ABSTRACT

The toy rocket launcher includes an elongated launch tube and a pusher assembly which slides inside the launch tube in an air-tight relationship. A launch head assembly is rotatably mounted on a forward end of the launch tube and has a plurality of launch ports for receiving toy rockets. The forward end of the launch tube assembly includes a small opening which mates with one of a plurality of air passageways in the launch head assembly. Each air passageway connects with a different launch port. As the head assembly is rotated by hand on the launch tube, a flow of air from the launch tube produced by user action on the pusher assembly is directed to successive launch ports, thereby launching successive toy rockets from the launch head assembly.

8 Claims, 5 Drawing Sheets

TOY ROCKET LAUNCHER FOR MULTIPLE SOFT TOY ROCKETS

TECHNICAL FIELD

This invention relates generally to the art of soft foam toy rockets. More specifically, it concerns an air pressure launcher for such toy rockets.

BACKGROUND OF THE INVENTION

Launchers for soft foam toy rockets are known, as shown for instance in U.S. Pat. No. 6,568,985. Such launchers, however, can only launch one rocket at a time, i.e. after one rocket is launched, a new rocket must be positioned on the launcher by the user. This results in a significant time lag between successive rocket launchings. It would be desirable to be able to launch a plurality of rockets in quick succession, using a single air pressure launching system.

DISCLOSURE OF THE INVENTION

Accordingly, the present invention is a toy rocket launching assembly, comprising: an elongated launch tube; a pusher assembly which fits moveably inside of the launch tube in an air-tight relationship therewith; a launch head assembly mounted on a forward end of the launch tube so as to be rotatable thereabout, the launch assembly including a plurality of launch ports at an upper end thereof for receiving a plurality of toy rockets, wherein the launch head assembly and an upper end of the launch tube are configured such that as the launch head assembly is rotated, an air pathway opens between the interior of the launch tube and successive launch ports in the launch head assembly; and a plurality of toy rockets adapted to be fitted onto the launch ports, wherein as the launch head assembly is rotated to successive launch port positions, movement of the pusher assembly into the launch tube produces sufficient air pressure at a selected launch port that a toy rocket mounted thereon is launched therefrom.

BEST MODE FOR CARRYING OUT THE INVENTION

Figure 1:
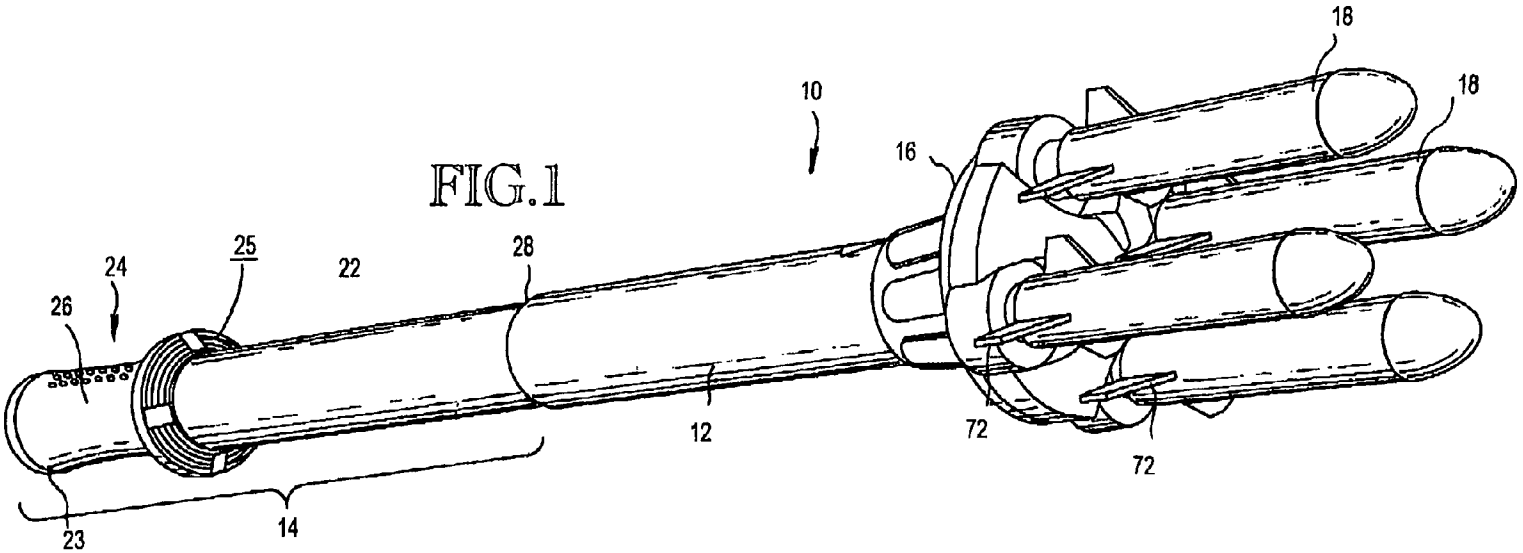
FIG. 1 is a perspective view of the toy rocket launcher with the pusher assembly portion thereof extended from the launch tube.
Figure 2:
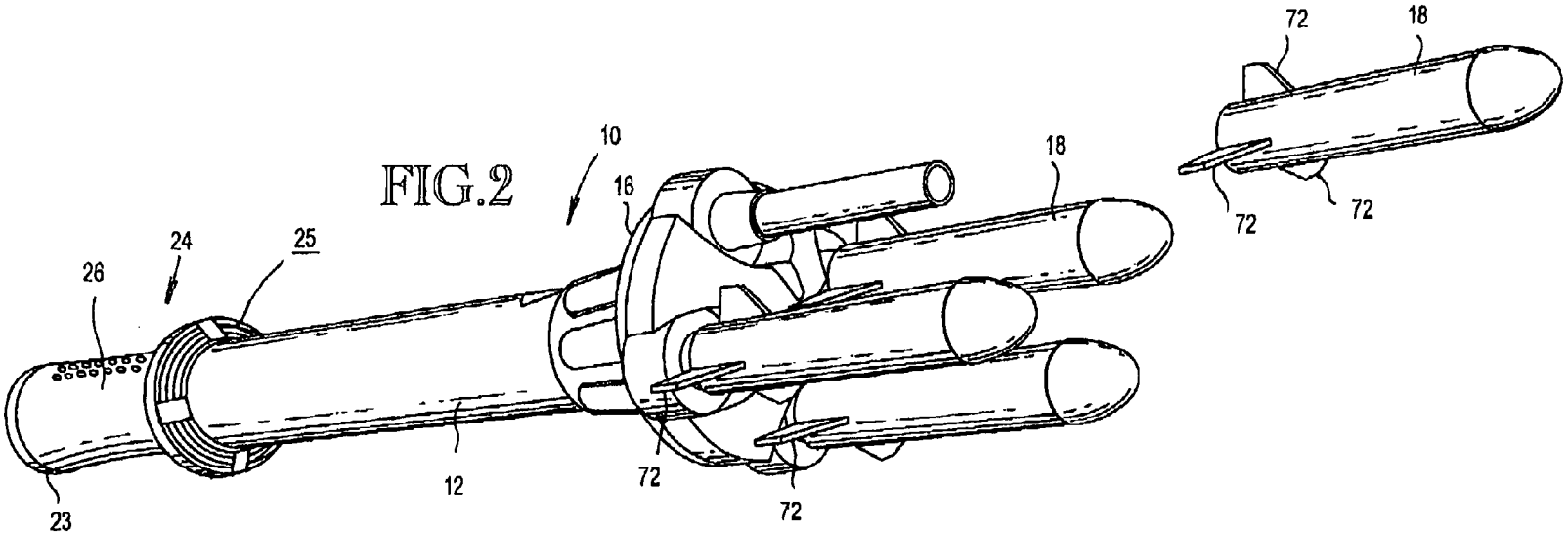
FIG. 2 is a perspective view of the toy rocket launcher with the pusher assembly fully inserted into the launch tube, showing a toy rocket flying off the launcher.
Figure 3:
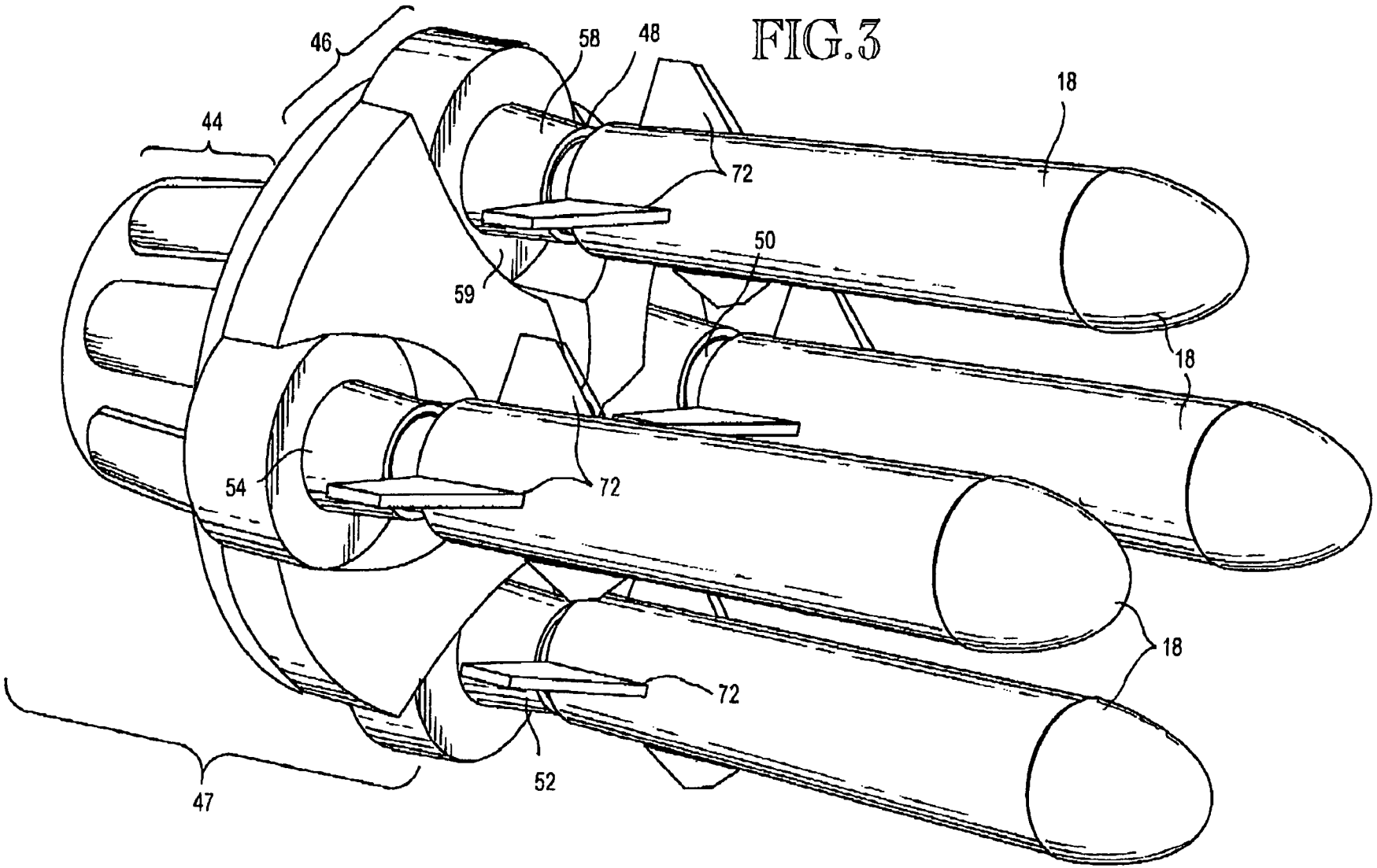
FIG. 3 is a close-up of a head portion of the toy rocket launcher.

A toy rocket launcher with multiple soft toy rockets mounted thereon is shown generally at 10 in FIGS. 1 and 2.

The rocket launcher 10 includes a launch tube 12, a pusher assembly 14 which fits into, and moves relative to, launch tube 12, and a launch head assembly 16 which is positioned on a forward end of launch tube 12. The launch head assembly is designed to support a plurality of soft toy rockets 18-18.

In general operation, air is forced through an opening in the upper end of launch tube 12 by the action of pusher arm 14 being forced into launch tube 12 by a user's manual operation, with the forced air directed to a selected portion of the launch head assembly which is in fluid communication with one soft toy rocket 18, producing a launch of the rocket away from the launch head assembly 16.

Figure 7:
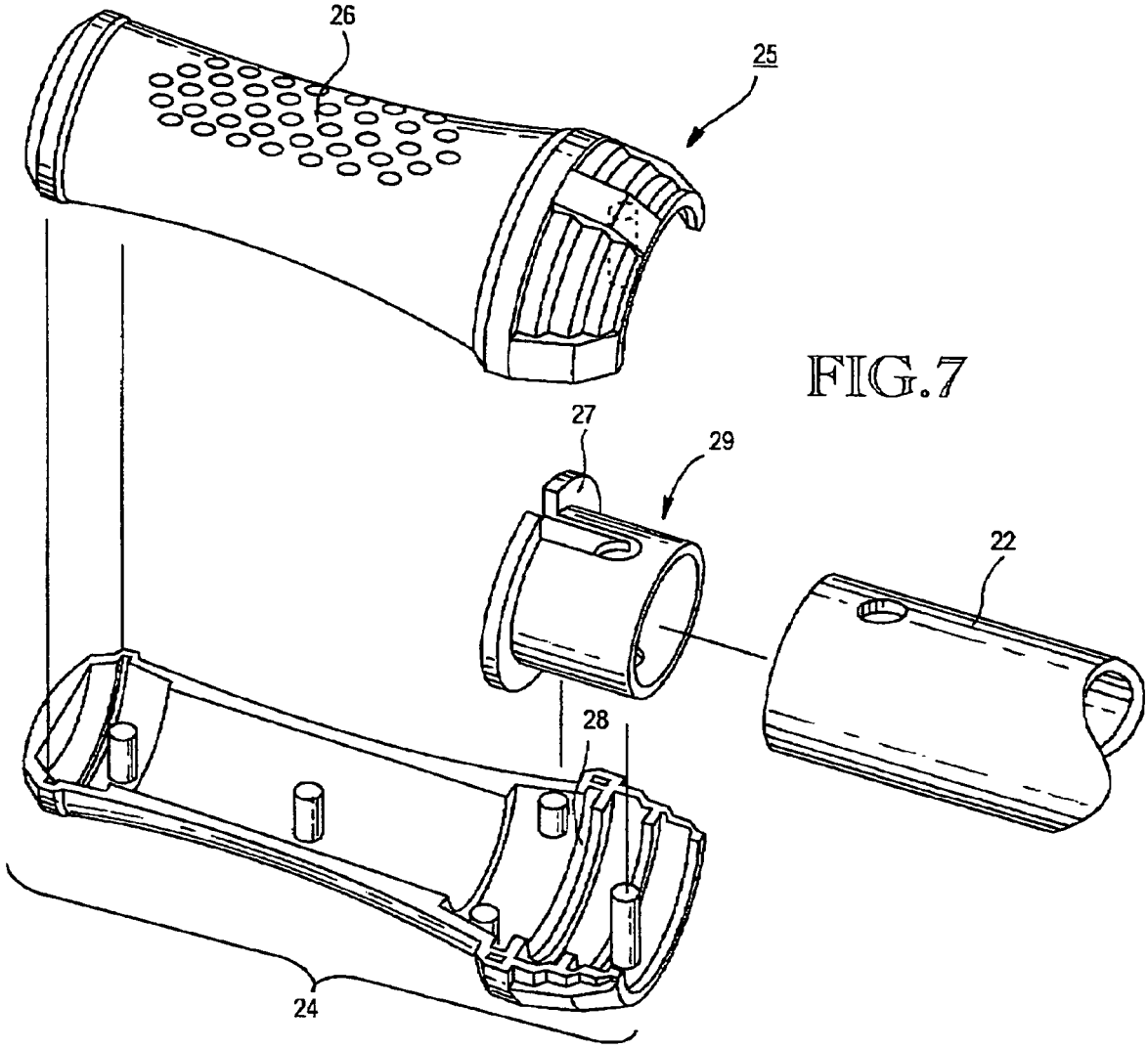
FIG. 7 is an exploded view of the handle portion of the toy rocket launcher.

Now referring to the Figures in more detail, launch tube 12 is a hollow cylindrical member approximately 18 inches long by 2 inches in diameter and is made of a rigid plastic material. Pusher assembly 14 includes a hollow cylindrical tube 22 which fits into the interior of the launch tube 12 in a slideable but air-tight relationship. At the rear end of tube 22 is a handle member 24, a forward surface section 25 which abuts against a rear end 28 of launch tube 12 when the pusher assembly 14 is fully inserted into the launch tube 12. Handle member 24 includes a grip portion 26 which is slightly curved, for the user to grasp, and secures the handle 24 to the pusher assembly tube 22 and a forward cap member 29 (FIG. 7) which fits into the end of pusher assembly tube 22. The cap member 23 includes a lip 27 at a rear end thereof which fits into a circumferential slot 28 in the interior surface of the grip portion 24. The upper end of the grip portion surrounds and contacts the lower end of the pusher assembly tube 22. The surface section 25 gradually decreases in diameter between the circumferential slot 28 and the forward end of the handle.

Figure 4:
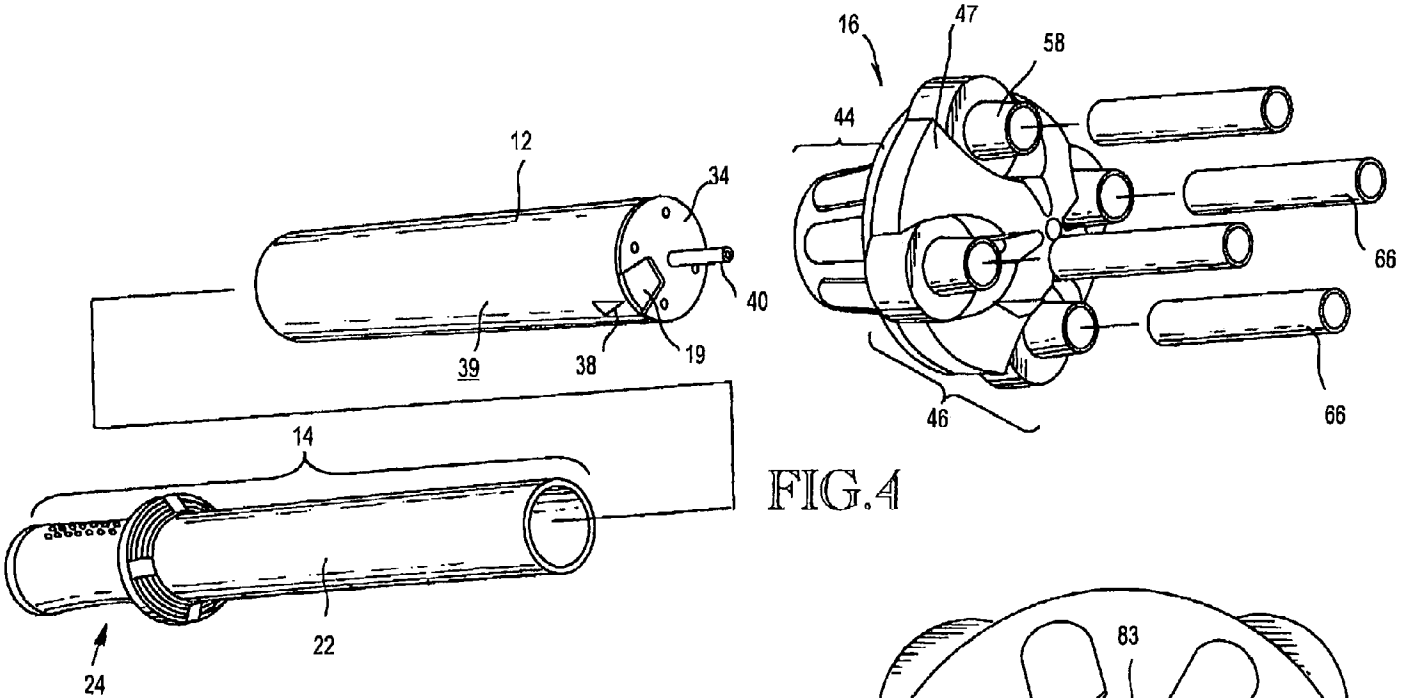
FIG. 4 is an exploded view of a portion of the toy rocket launcher of FIG. 1.

At the forward end of launch tube 12 is a plate 34 (FIG. 4) with an opening 19, through which air moves when pusher assembly 14 is moved forcibly into launch tube 12. Launch tube 12 also includes an arrow or other indicia 38 on its peripheral surface 39 near the forward end thereof, indicating the position of opening 19.

Extending from the center of plate 34 is an elongated centering rod 40 which centers and connects the launch head assembly 16 to the forward end of launch tube 12.

The launch head assembly 16 fits removably on the forward end of the launch tube 12 and is designed to rotate about launch tube 12 by action of the user. The launch head assembly 16 includes a lower portion 44 which rotatably mates with the launch tube and is configured to curve outwardly near its upper end to the lower end of an upper portion 46 thereof. Upper portion 46 includes four identical, spaced launch ports 48, 50, 52 and 54. Each launch port (launch port 48 is exemplary) includes a short, thin-walled hollow cylinder portion 58 which extends upwardly from a shallow portion/cavity 59 in the upper surface 47 of upper portion 46. Surrounding the thin-walled cylinder portion 58 is an open space, which defines cavity 59. Cavity 59 accommodates one soft toy rocket 58 which has an internal plastic sleeve 66, a lower end 67 of which is designed to fit tightly into the thin-walled cylinder portion 58. In the embodiment shown, each thin-walled cylinder portion 58 is approximately ¾-inch high and angles slightly inwardly from its base end, which is connected to or part of upper portion 46, to its upper, free end into which sleeve 66 of a toy rocket is fitted.

The toy rockets are, in the embodiment shown, approximately 10 inches long. Each toy rocket has, as indicated above, a hard plastic internal sleeve 66, which is designed to fit into, in a tight relationship, its associated thin-walled cylinder portion 58 on the launch head assembly. Each toy rocket includes an elongated foam body section 68 and a foam nose section 70 which tapers to a soft point. The foam body section has an air-tight relationship with the plastic sleeve 66. The internal sleeve 66 extends for most of the length of the rocket and extends below the lower edge of the body section 70 a sufficient distance that it can be tightly positioned into its associated thin-walled cylinder portion. At the lower end of body section 68 are three spaced stabilizing fins 72-72 which are made from a foam material, which stabilize the rocket in its flight.

Figure 5:
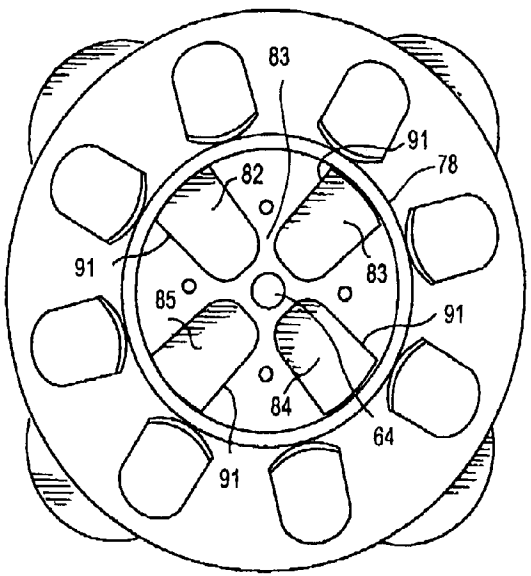
FIG. 5 is a bottom view of the head portion of the toy rocket launcher.
Figure 6:
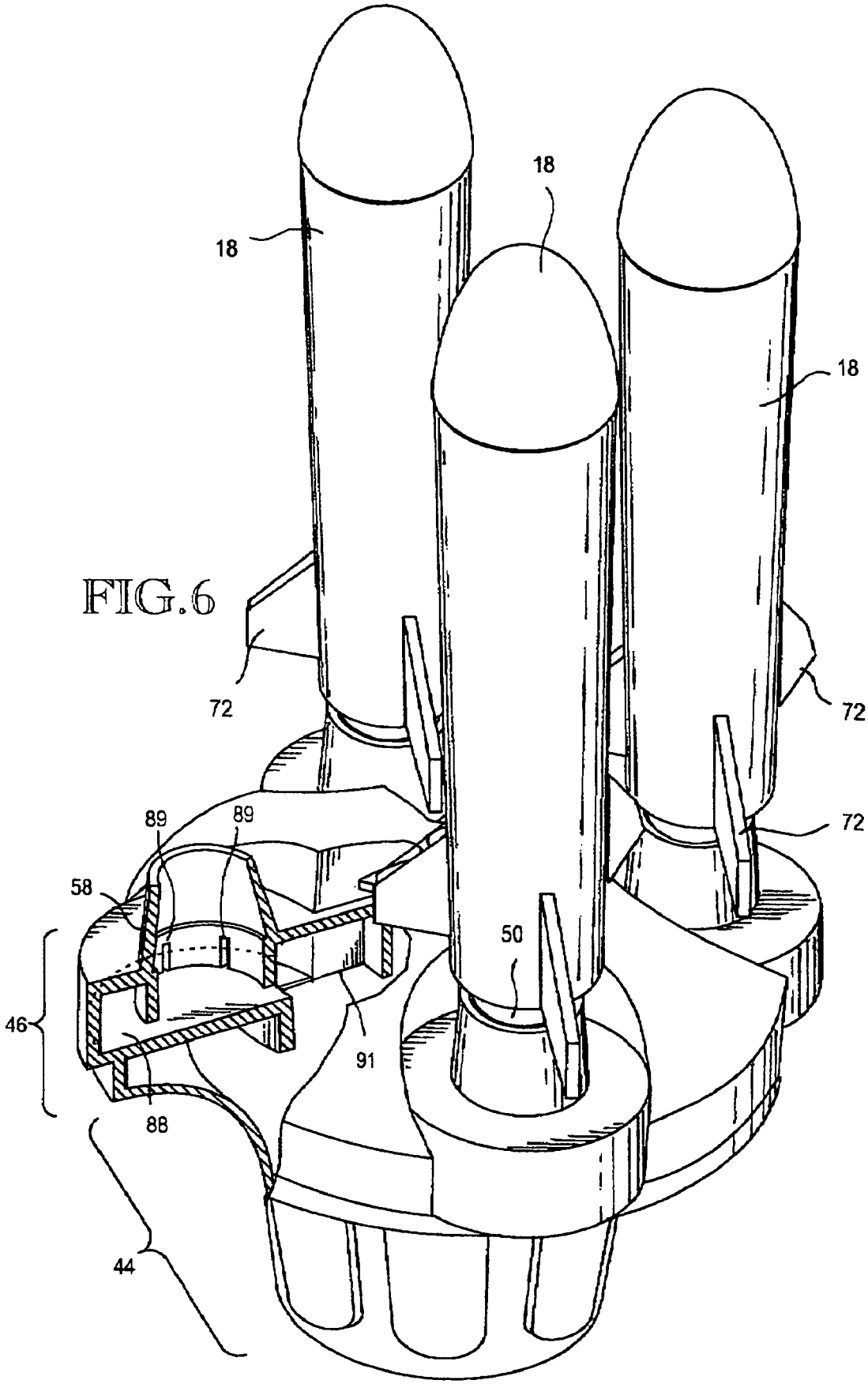
FIG. 6 is a partial lateral cross-sectional view of the head portion showing a portion of the arrangement receiving air flow into the head portion produced by action of the launch tube.

FIGS. 5 and 6 show the interior of the launch head assembly, including the structural arrangement for directing air which exits from launch tube opening 19 into one of the launch ports 48, 50, 52 or 54, depending on the rotational position of the launch head assembly on the launch tube 12. Looking into the interior of the head assembly, from the lower end thereof, in the center of the upper portion 46 of the launch head assembly is an opening 64 which receives centering rod 40 from launch tube 12. Rod 40 acts as a guide in positioning launch head assembly 16 onto launch tube 12. Surrounding opening 64 is a circular wall 78, which is approximately ¼-inch high and has a diameter such that the top end of launch tube 12 fits snugly thereinto in an air-tight relationship. Between opening 64 and circular wall 78 are defined four spaced air chambers 82, 83, 84 and 85. Each air chamber is identical, and has a fluid connection with one associated launch port 48, 50, 52 and 54 in the upper portion of the launch head assembly.

Air chamber 82 is exemplary. Air chamber 82 is approximately ½-inch deep and extends from approximately a center area 81 of the upper portion 46 of the launch head assembly, passing under circular wall 78 and terminating at a circular portal area 86 (FIG. 6) which surrounds an entry portion 88 of its associated thin-walled cylinder, located beneath the surface of cavity portion 59 of the launch head assembly. The entry portion 88 includes four spaced, vertical slots 89 which provide air communication between entry portion 88 and the interior of the thin-walled cylinder 58.

When the launch tube 12 is fully inserted into the head assembly, plate 34 at the upper end of the launch tube comes adjacent the upper edge 91 of each of the air chambers 82-85, in an air-tight relationship. Opening 19 in plate 34 (indicated by indicia 38) is in registry with the one air chamber and the one launch port which lines up with the indicia 38. Hence, an air path for the flow of air under pressure produced by the action of a user on pusher 14 is defined between launch tube 12, opening 19 in plate 34, a selected air chamber, and the interior of a selected launch port, depending on the rotational position of the launch head assembly. That air path is air-tight, i.e. there is little or no leakage of air from that structural path to the outside or to another air chamber.

In operation, pusher assembly 14 is first pulled outwardly to its extended position by handle 24, as shown in FIG. 1, with one or more soft toy rockets, respectively, positioned on launch ports 48, 50, 52, and 54. In the embodiment shown, as indicated above, a total of four rockets can be positioned on the launch head assembly at any one time, although this number could be varied, depending upon the particular configuration of the launch head assembly. The pusher assembly is rapidly moved into the launch tube, forcing air present in the launch tube 12 out opening 19 at a relatively high pressure. The air moves into the one air chamber in registry with opening 19 and then into the interior of the associated launch port and then further into the interior of the toy rocket. The buildup of air pressure is great enough that it forces the foam body section 68 of the rocket to be launched off its internal sleeve 66 from the launch port, at distances of 50-100 feet. The internal sleeve 66 remains behind, in the launch portion to which it was tightly fitted, as shown in FIG. 2.

After one rocket is launched, the launch head assembly is rotated by hand so that the indicia 38 on the exterior surface of the launch tube lines up with a second launch port. The above-described steps are then repeated and the second rocket is launched. This continues until all the rockets on the launch head assembly are launched. A plurality of soft toy rockets can thus be launched in a relatively fast sequence, without the necessity of having to place a new rocket on a single launch port after every launch. After a rocket lands, it can be retrieved and fitted back on the internal sleeve for a subsequent use, or the sleeve can be removed and fitted into the body section 68, again for future use.

Although a preferred embodiment of the invention has been disclosed for purposes of illustration, it should be understood that various substitutions, modifications and changes can be accomplished without departing from the spirit of the invention which is defined by the claims as follows.

What is claimed is:

1. A toy rocket launching assembly, comprising:

an elongated launch tube;

a pusher assembly which fits moveably inside of the launch tube in an airtight relationship therewith;

a launch head assembly mounted on a forward end of the launch tube so as to be rotatable thereabout and removable therefrom, the launch head assembly fitting onto the forward end of the launch tube in an air-tight relationship, the launch head assembly including a plurality of launch ports at an upper end thereof for receiving a plurality of toy rockets in a tightly fittable relationship, wherein the launch head assembly includes a plurality of spaced air passageways, each air passageway having an air entry opening, with airtight communication between each of said openings and an associated launch port, wherein the launch tube has an opening in the forward end thereof which is configured to be in air tight communication with successive air entry openings in the launch head assembly as the launch head assembly is rotated, such that successive air passageways open between the launch tube and successive launch ports in the launch head assembly; and a plurality of toy rockets adapted to be fitted onto the launch ports, wherein as the launch head assembly is rotated to successive launch port positions, movement of the pusher assembly into the launch tube produces sufficient air pressure at a selected launch port that a toy rocket mounted thereon is launched therefrom.

2. The rocket launching assembly of claim 1, wherein the pusher assembly includes a handle assembly which prevents the pusher assembly from being moved into the launch tube beyond a selected distance.

3. The rocket launching assembly of claim 2, wherein the handle portion is located at a lower end of the pusher assembly and includes a portion which prevents further movement of the pusher assembly into the launch tube.

4. The rocket launching assembly of claim 1, wherein in operation the pusher assembly moves from an extended position relative to the launch tube to an operative position located substantially completely into the launch tube, resulting in air being moved vigorously through the air pathway to a launch port, forcing the rocket mounted thereon out away from the launch head assembly.

5. The rocket launching assembly of claim 1, including four spaced launch ports in the launch head assembly, each launch port including a thin-walled cylinder protruding outwardly from a surface portion of the launch head assembly, on which cylinder a toy rocket can be mounted, each launch port further including an air entry portion in communication with an associated air passageway in the launch head assembly.

6. The rocket launching assembly of claim 1, wherein the launch tube includes an indicia on an outer surface thereof indicating the position of the opening in the forward end thereof, so that a user can conveniently line up the opening in the forward end of the launch tube with a selected air passageway in the launch head assembly, wherein the opening in the forward end of the launch tube comes into registry with the air entry openings in the launch head assembly successively as the launch head assembly is rotated.

7. The rocket launching assembly of claim 1, wherein the launch head assembly includes a receiving portion which includes a circular wall which receives the upper end of the launch tube in an air-tight relationship and a central opening which receives a rod member extending from the upper end of the launch tube for centering of the launch head assembly on the launch tube.

8. The rocket launching assembly of claim 1, wherein the toy rockets include a rigid plastic inner sleeve, which is tightly fittable into a launch port, and a soft foam external body portion into which the inner sleeve fits, wherein the soft foam body portion flies off the inner sleeve during launch, leaving the inner sleeve in place on a launch port.

* * * * *